US007980626B1

(12) United States Patent
Chen

(10) Patent No.: US 7,980,626 B1
(45) Date of Patent: Jul. 19, 2011

(54) PICNIC TABLE

(75) Inventor: Yun-Lu Chen, Ping-Tung (TW)

(73) Assignee: Danny Plastics Co., Ltd., Ping-Tung (TW)

( * ) Notice: Subject to any disclaimer, the term of this patent is extended or adjusted under 35 U.S.C. 154(b) by 0 days.

(21) Appl. No.: 12/647,045

(22) Filed: Dec. 24, 2009

(51) Int. Cl.
*A47B 39/00* (2006.01)

(52) U.S. Cl. ..... 297/158.3; 297/158.5; 108/161; 108/157.16; 108/158.11; 108/158

(58) Field of Classification Search .... 297/158.3–158.5; 108/161, 157.16, 158.11, 158
See application file for complete search history.

(56) References Cited

U.S. PATENT DOCUMENTS

| | | | | | |
|---|---|---|---|---|---|
| 2,568,622 | A | * | 9/1951 | Hagan | 297/158.4 |
| 2,811,197 | A | * | 10/1957 | Nimmo | 297/158.4 |
| 2,964,368 | A | * | 12/1960 | Heyer | 108/155 |
| 3,189,379 | A | * | 6/1965 | Potter | 297/158.5 |
| 3,276,815 | A | * | 10/1966 | Cardy | 297/158.4 |
| 4,043,278 | A | * | 8/1977 | Kessler et al. | 108/150 |
| 4,060,275 | A | * | 11/1977 | Hansen | 297/158.4 |
| 4,146,269 | A | * | 3/1979 | Beckley | 297/440.18 |
| 4,522,443 | A | * | 6/1985 | Van Blankenburg | 297/158.3 |
| 4,662,591 | A | * | 5/1987 | Encontre | 248/188 |
| 5,085,486 | A | * | 2/1992 | Johnson | 297/3 |
| 5,752,450 | A | | 5/1998 | Roesner | |
| 6,142,560 | A | * | 11/2000 | Miller | 297/158.4 |

FOREIGN PATENT DOCUMENTS

| | | | |
|---|---|---|---|
| DE | 93 01 978 | U1 | 5/1993 |
| KR | 200 442 707 | Y1 | 12/2008 |

* cited by examiner

*Primary Examiner* — Laurie K Cranmer
(74) *Attorney, Agent, or Firm* — Alan Kamrath; Kamrath & Associates PA

(57) ABSTRACT

A picnic table includes at least two leg units, a crossbar, a table top and two benches. Each leg unit includes two J-shaped legs. Each J-shaped leg includes a table top support portion formed thereon, a bench support portion formed thereon, and a recess defined in the table top support portion. The crossbar is located between the leg units. The table top includes planks and tubes for supporting the planks. The table top is supported on the table top support portions while the tubes are received in the recesses. Screws are used to secure the crossbar to the legs, secure the table top to the table top support portions, and secure the benches to the bench support portions.

5 Claims, 8 Drawing Sheets

PICNIC TABLE

BACKGROUND OF THE INVENTION

The present invention relates to a picnic table and, more particularly, to a robust, easy-to-transport, easy-to-make, durable picnic table for indoor and outdoor use.

There are various picnic tables in public places such as parks, campuses, restaurants and beer houses and private places such as dinning rooms or yards. As most of picnic tables are used outdoors, they are generally made of corrosion-resistant, heat-resistant and strong materials such as metal and wood. Such picnic tables are however heavy, difficult-to-transport and difficult-to-make. It often requires a large space to store and transport such a picnic table because the sizes of its parts are poorly designed. Further, it often requires a trained worker to assemble such parts to make such a picnic table, and this is labor-demanding and expensive.

The present invention is therefore intended to obviate or at least alleviate the problems encountered in prior art.

BRIEF SUMMARY OF THE INVENTION

It is the primary objective of the present invention to provide a robust, easy-to-transport, easy-to-make, durable picnic table.

To achieve the foregoing objective, the picnic table includes at least two leg units spaced in a longitudinal direction. Each leg unit includes two legs each having J-shaped cross sections perpendicular to the longitudinal direction. Each leg includes a longer post, a shorter post, and a base extending from the longer post to the shorter post. Each leg further includes a table top support portion extending from an upper end of the longer post, and a bench support portion extending from an upper end of the shorter post. Each leg further includes a recess defined in an upper face of the table top support portion. The picnic table further includes a crossbar extending in the longitudinal direction. The crossbar includes two ends spaced in the longitudinal direction. Each end of the crossbar is located between the longer posts of the legs of one of the leg units. The picnic table further includes a table top including planks, bars for supporting the planks in a transverse direction perpendicular to the longitudinal direction, and tubes for supporting the planks in the longitudinal direction. The table top is supported on the table top support portions of the legs with the tubes being received in the recesses of the table top support portions. The picnic table further includes two benches supported on the bench support portions of the two leg units in the longitudinal direction. The picnic table further includes screws for securing the crossbar to the legs of the two leg units, securing the table top to the table top support portions of the legs, and securing the benches to the bench support portions of the legs.

In a preferred form, each leg further includes a ridge extending from the table top support portion to the bench support portion through the longer post, the base, and the lower post for reinforcement.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
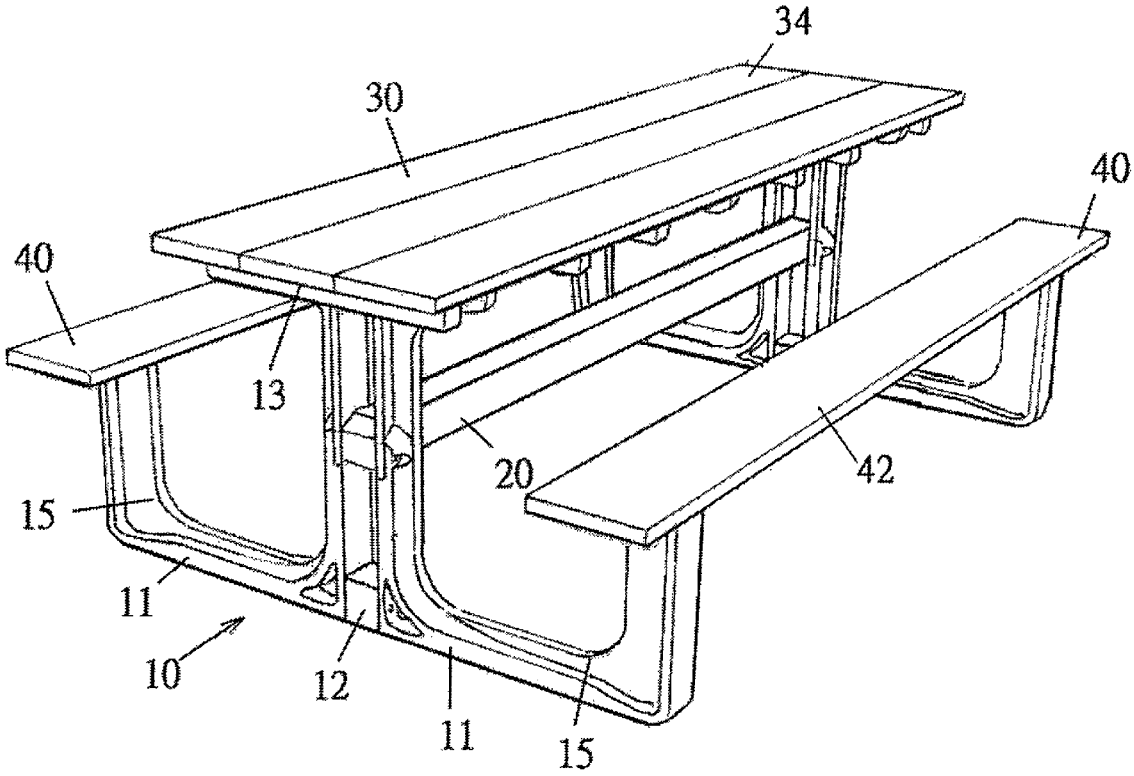
FIG. 1 is a perspective view of a picnic table according to a first embodiment of the present invention.
Figure 2:
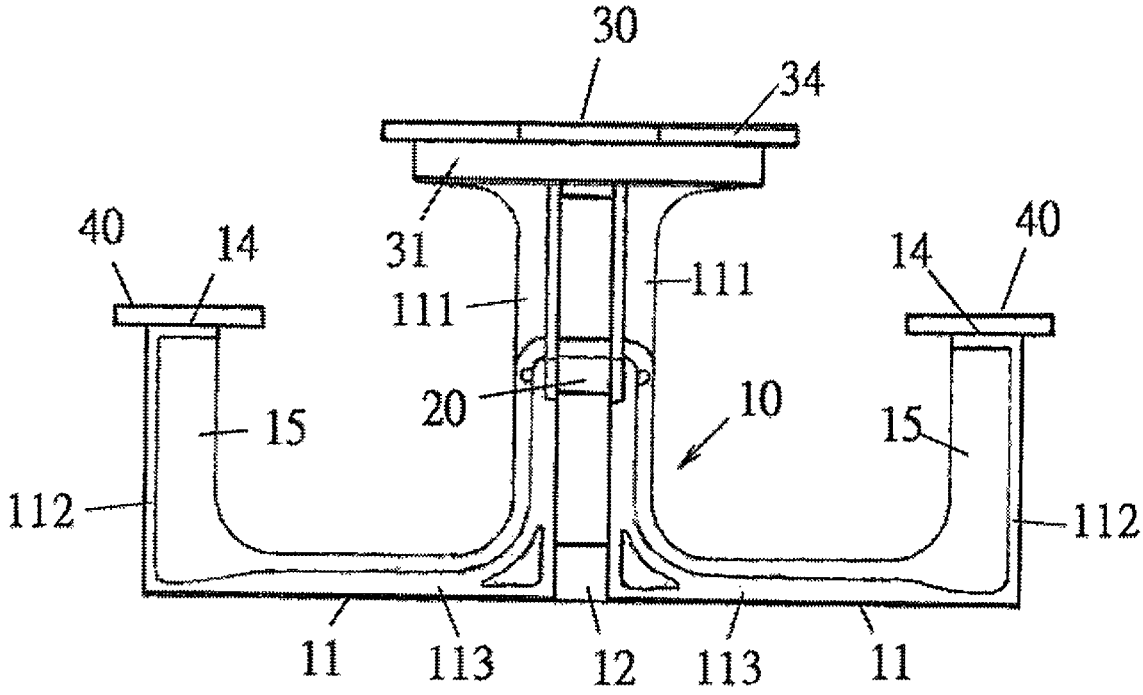
FIG. 2 is a side view of the picnic table shown in FIG. 1.

Referring to FIGS. 1 and 2, a picnic table includes a frame for supporting a table top 30 and two benches 40 according to a first embodiment of the present invention. The table top 30 is located between the benches 40. The frame, the table top 30, and the benches 40 are made by mold injection of a recyclable material such as poly propylene ("PP") and poly ethylene ("PE").

Figure 3:
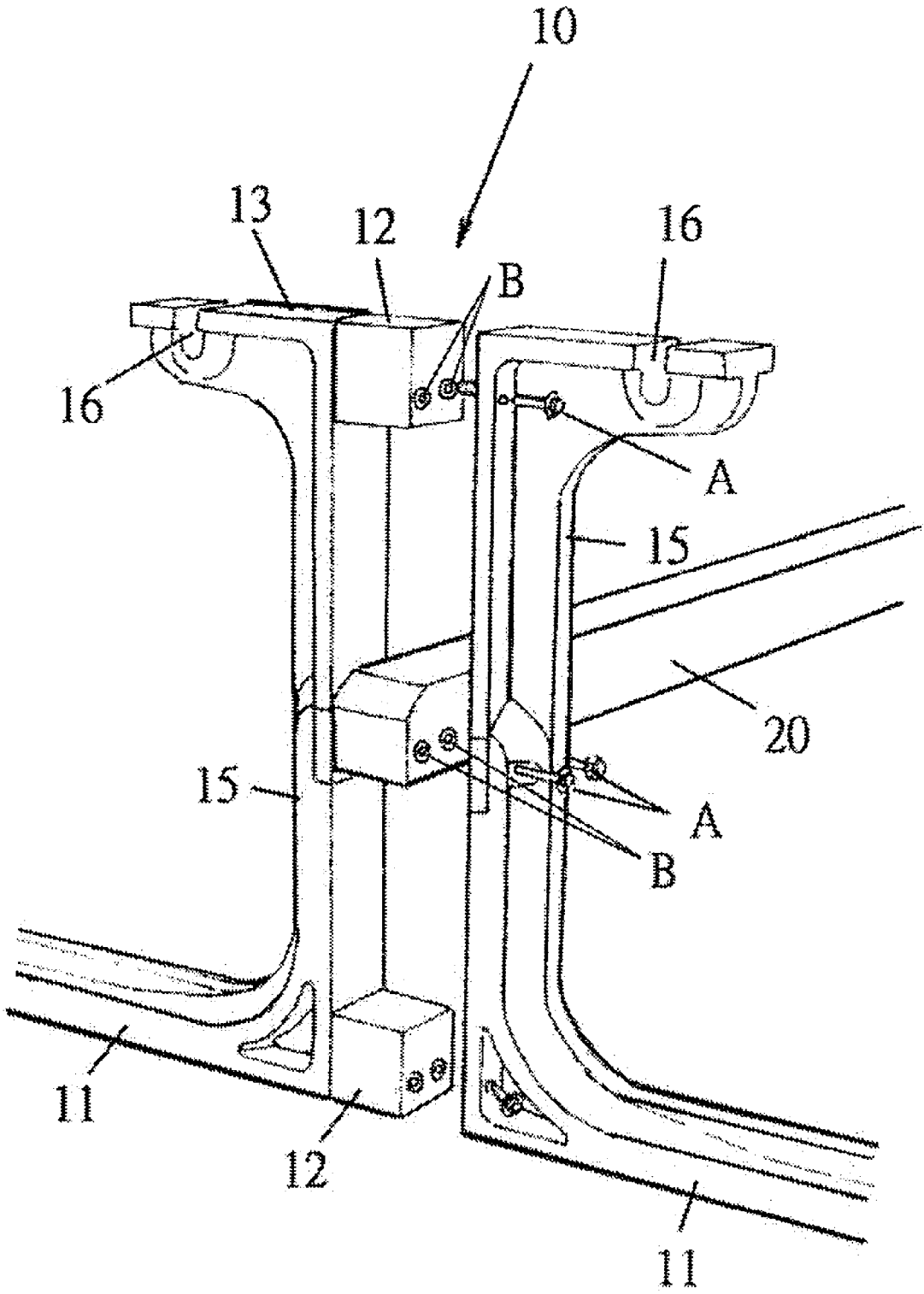
FIG. 3 is a perspective view of a frame of the picnic table shown in FIG. 1.

Referring to FIGS. 1 through 3, the frame includes two leg units 10 spaced in a longitudinal direction. Each leg unit 10 includes two J-shaped legs 11 each having J-shaped cross sections perpendicular to the longitudinal direction. Each leg 11 includes a longer post 111, a shorter post 112, and a base 113 extending from the longer post 111 to the shorter post 112. Each leg 11 further includes a table top support portion 13 extending from an upper end of the longer post 111 and a bench support portion 14 extending from an upper end of the shorter post 112. Each leg 11 further includes a ridge 15 extending from the table top support portion 13 to the bench support portion 14 through the longer post 111, the base 113, and the lower post 112. Thus, each leg 11 is reinforced with the ridge 15. In addition, each leg 11 includes a recess 16 defined in an upper face of the table top support portion 13 thereof.

The frame further includes a crossbar 20 extending in the longitudinal direction, and two pairs of pads 12 provided between the leg units 10. Each end of the crossbar 20 is located between the longer posts 111 of the legs 11 of one of the leg units 10. Each pair of pads 12 is located between the longer posts 111 of the legs 11 of one of the leg units 10. The longer posts 111 of the legs 11 are connected to the pads 12 and the crossbar 20 with screws A. To this end, nuts B are embedded in the pads 12 and the crossbar 20 beforehand. By engaging the screws A with the nuts B, the crossbar 20, the pairs of pads 12, and the legs 11 can easily be assembled. By disengaging the screws A from the nuts B, the crossbar 20, the pairs of pads 12, and the legs 11 can easily be disassembled.

Figure 4:
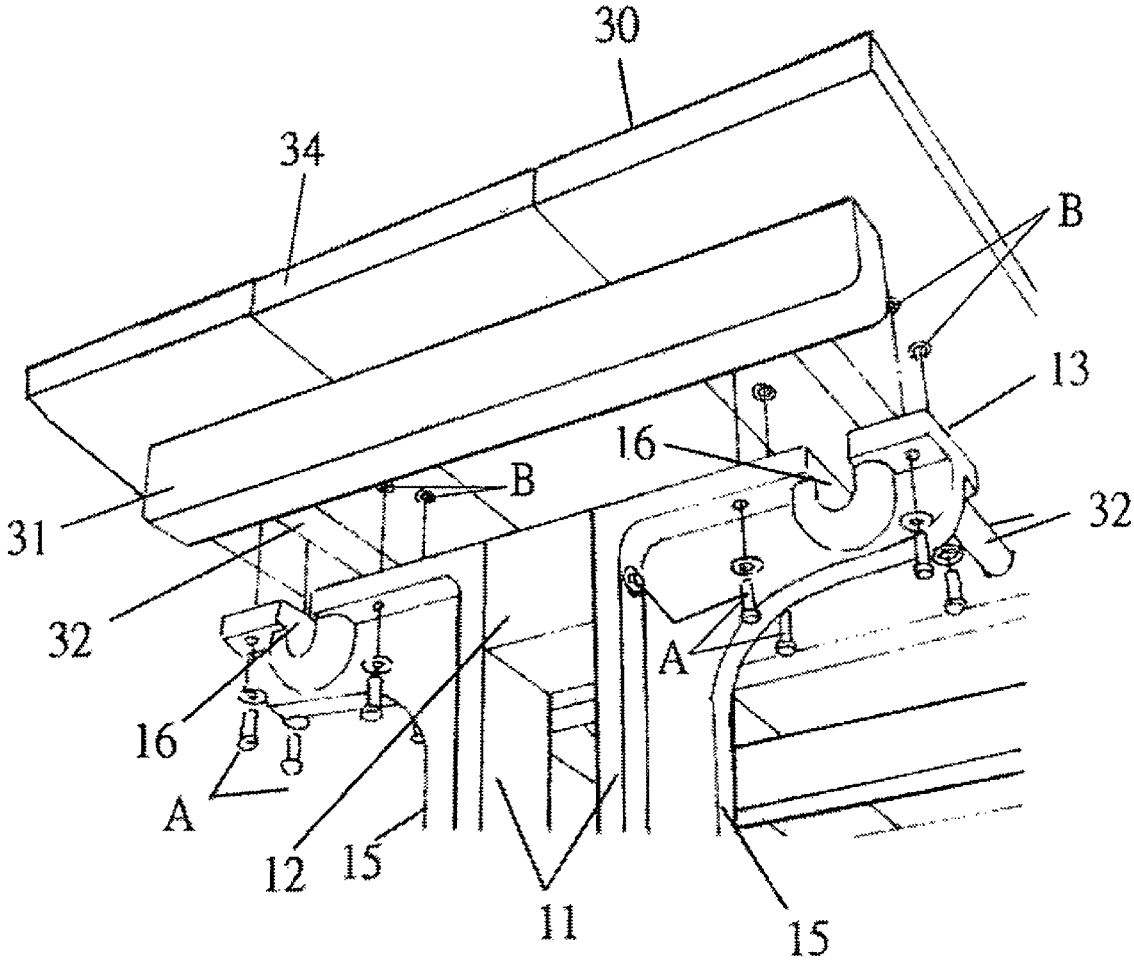
FIG. 4 is a partial, exploded view of the picnic table shown in FIG. 1.

The table top 30 is preferably made of several planks 34 supported on several bars 31 and two tubes 32 (see FIG. 4). In a top view of the table top 30, the length of each of the bars 31 is in perpendicular to the length of each of the planks 34. Thus, the bars 31 provide the table top 30 with reinforcement in a transverse direction perpendicular to the longitudinal direction. In the top view, the length of each of the tubes 32 is in parallel to the length of each of the planks 34. Thus, the tubes 32 provide the table top 30 with reinforcement in the longitudinal direction.

Referring to FIGS. 1 and 4, the table top 30 is supported on the table top support portions 13 of the legs 11 with the tubes 32 being received in the recesses 16. A lower face of the table top 30 is in contact with the upper faces of the table top support portions 13 of the legs 11. The table top 30 is connected to the table top support portions 13 of the legs 11 with screws A. To this end, nuts B are embedded in the table top 30 beforehand. By engaging the screws A with the nuts B, the table top 30 and the legs 11 can easily be assembled. By disengaging the screws A from the nuts B, the table top 30 can easily be detached from the legs 11.

Figure 5:
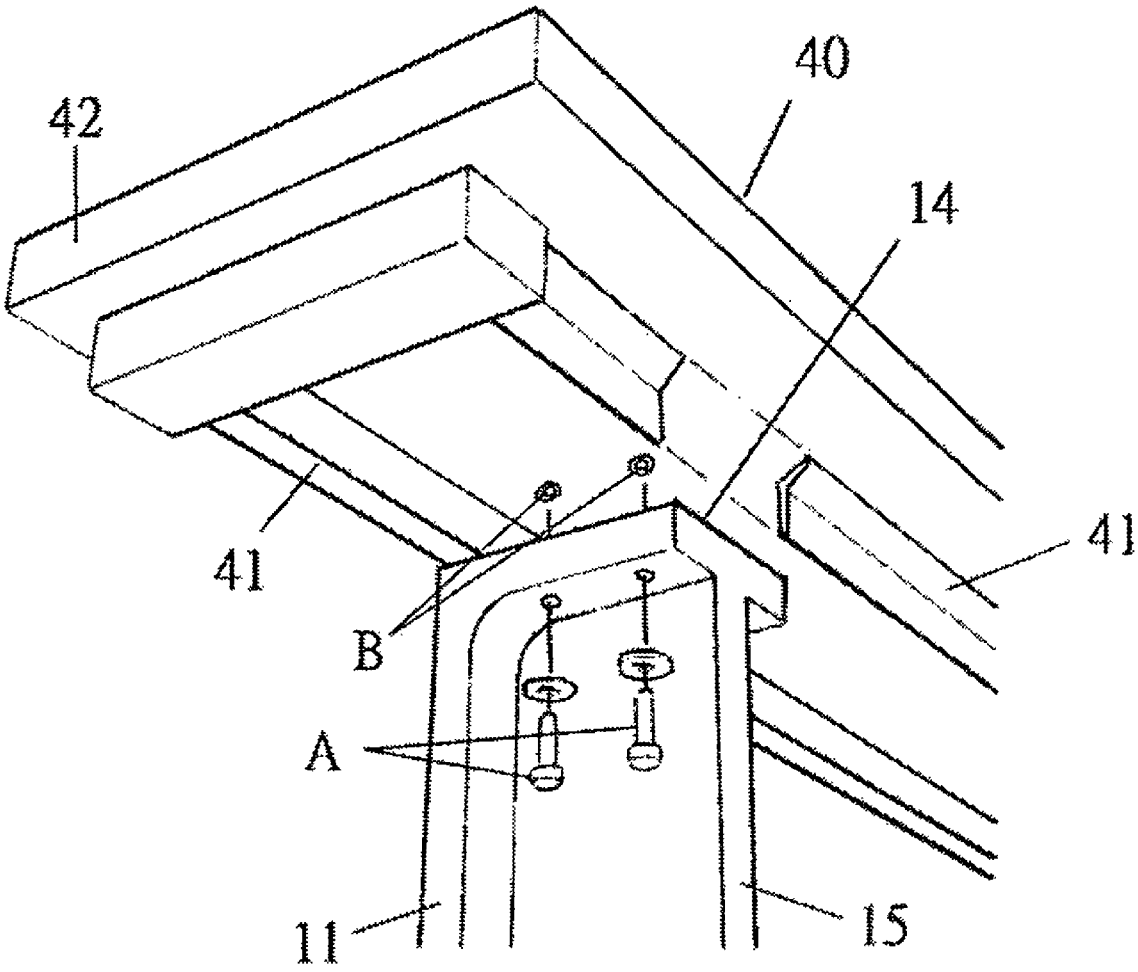
FIG. 5 is another partial, exploded view of the picnic table shown in FIG. 1.

Each of the benches 40 includes at least one plank 42 supported on two angle bars 41 extending in the longitudinal direction (see FIG. 5). The length of each angle bar 41 is in parallel to the length thereof. Thus, the angle bars 41 provide the benches 40 with reinforcement in the longitudinal direction. The plank 42 can be wider than the planks 34 or they can be the same.

Referring to FIGS. 1 and 5, the benches 40 are supported on the bench support portions 14 of the legs 11. A lower face of each of the benches 40 is in contact with the upper face of the bench support portions 14 of two legs 11 opposite and spaced in the longitudinal direction. The benches 40 are connected to the bench support portions 14 of the legs 11 with screws A. To this end, nuts B are embedded in the benches 40 beforehand. By engaging the screws A with the nuts B, the benches 40 and the legs 11 can easily be assembled. By disengaging the screws A from the nuts B, the benches 40 can easily be detached from the legs 11.

Figure 6:
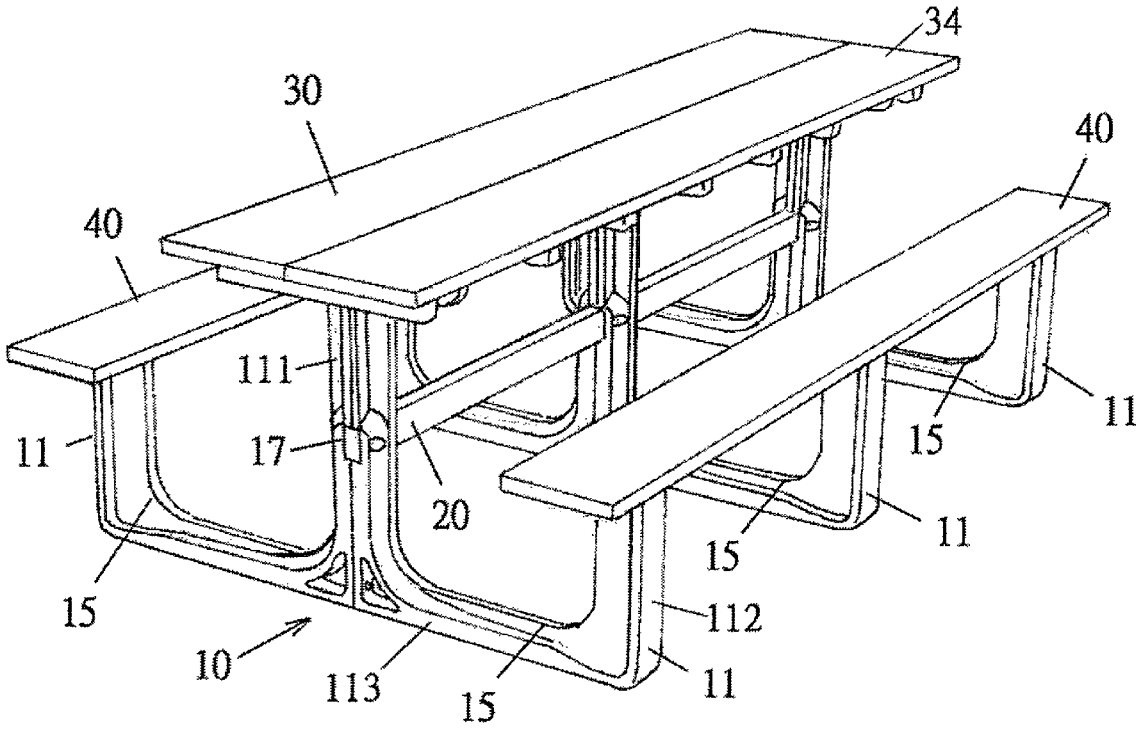
FIG. 6 is a perspective view of a picnic table according to a second embodiment of the present invention.
Figure 7:
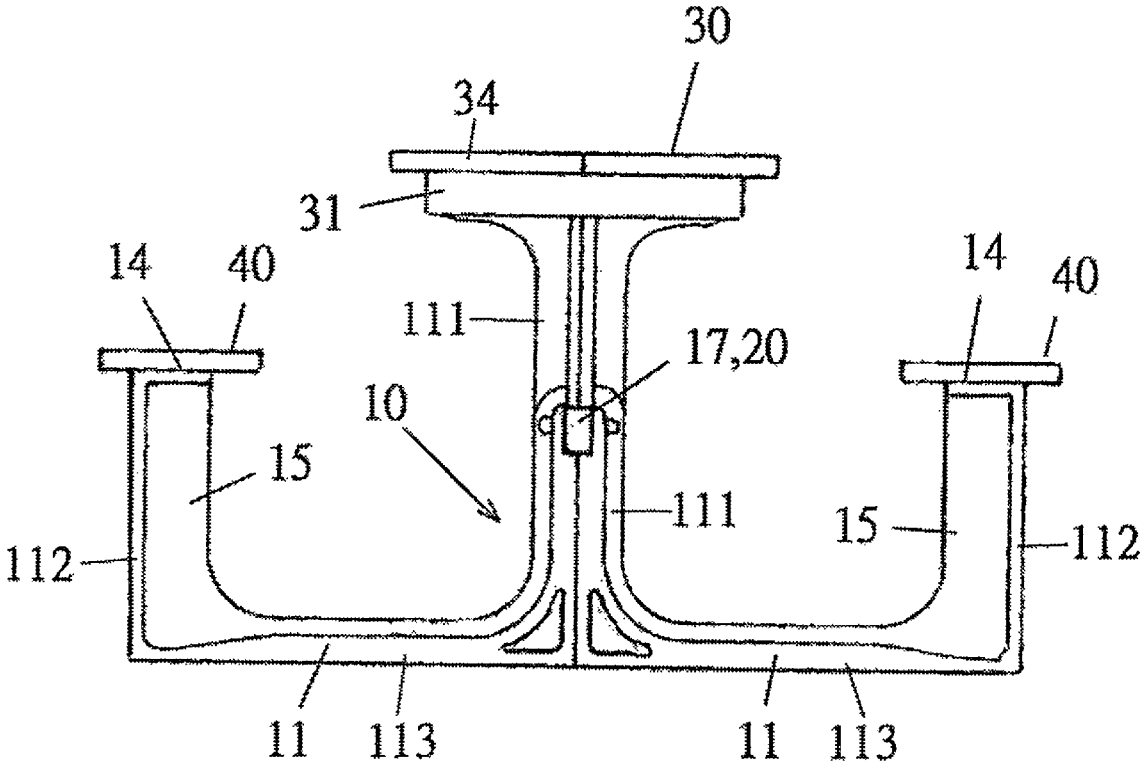
FIG. 7 is a side view of the picnic table of FIG. 6.

Referring to FIGS. 6 and 7, there is shown a picnic table according to a second embodiment of the present invention. The second embodiment is like the first embodiment except two things. Firstly, there are three leg units 10. Accordingly, the table top 30 is longer and narrower. The table top 30 is made of two longer planks 34. Similarly, the benches 40 are longer. Secondly, the pads 12 are omitted. The crossbar 20 is received in a recess 17 defined in the longer post 111 of each of the legs 11. There is no gap between the longer posts 111 of the legs 11 of each leg unit 10. A dimension of the picnic table is reduced.

Figure 8:
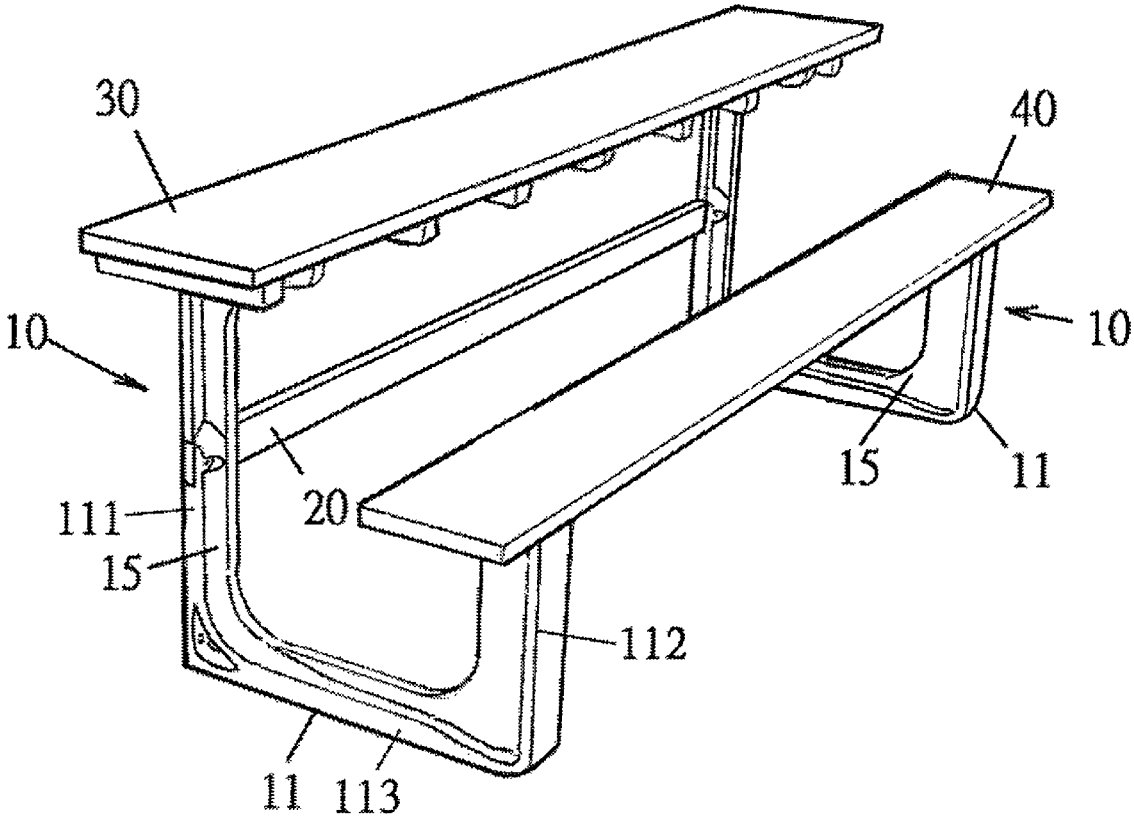
FIG. 8 is a perspective view of a picnic table according to a third embodiment of the present invention.

Referring to FIG. 8, there is shown a picnic table according to a third embodiment of the present invention. The third embodiment is like the first embodiment except including only two J-shaped legs 11 and only one bench 40. In the embodiment, each end of the crossbar 20 is connected to the longer post 111 of one of the two legs 11. The table top 30 includes a tube 32 which is received in the recesses 16 of the table top support portions 13 of the two legs 11. The size of the picnic table is reduced.

The picnic table exhibits several advantages. Firstly, it is robust for including the frame including the J-shaped legs 11 connected to the crossbar 20, the table top 30 and the bench or benches 40 with the screws A.

Secondly, it is easy to assemble the J-shaped legs 11, the crossbar 20, the table top 30 and the bench or benches 40 with the screws A.

Thirdly, its transportation and storage is easy since the J-shaped legs 11, the crossbar 20, the table top 30 and the bench or benches 40 are flat elements and can be stacked neatly.

Fourthly, the color of the table top 30 and that of the bench or benches 40 are a desire's choices to provide an aesthetical appearance since they are made of PP or PE.

Fifthly, the table top 30 and the bench or benches 40 can be recycled, and this is good for the protection of the environment.

Sixthly, different sizes can be achieved by changing the amount of the J-shaped legs 11, the amount of the planks 34 of the table top 30, the length of the planks 34 of the table top 30, the length of the bench or benches 40 and the length of the crossbar 20 without having to change the size of the J-shaped legs 11.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. A picnic table comprising:

two leg units spaced in a longitudinal direction, with each of the two leg units including two legs each having J-shaped cross sections perpendicular to the longitudinal direction, with each leg including a longer post, a shorter post, and a base extending from the longer post to the shorter post, with each leg further including a table top support portion extending from an upper end of the longer post, and a bench support portion extending from an upper end of the shorter post, with each leg further including a ridge extending from the table top support portion to the bench support portion through the longer post, the base, and the lower post, with each leg further including a recess defined in an upper face of the table top support portion;

a crossbar extending in the longitudinal direction, with the crossbar including two ends spaced in the longitudinal direction, with each end of the crossbar located between the longer posts of the legs of one of the leg units;

a table top including planks, bars for supporting the planks in a transverse direction perpendicular to the longitudinal direction, and tubes for supporting the planks in the longitudinal direction, wherein the table top is supported on the table top support portions of the legs with the tubes being received in the recesses of the table top support portions;

two benches supported on the bench support portions of the two leg units in the longitudinal direction; and screws securing the crossbar to the legs of the two leg units, securing the table top to the table top support portions of the legs, and securing the benches to the bench support portions of the legs.

2. The picnic table according to claim 1, further comprising nuts embedded in the crossbar, the table top, and the benches for engagement with the screws.

3. The picnic table according to claim 2, further comprising two pads located between the legs of each of the two leg units, wherein the pads are secured to the legs by screws.

4. The picnic table according to claim 3, wherein each of the two benches includes at least one plank and two angle bars for supporting the plank of the bench in the longitudinal direction.

5. A picnic table comprising:

two legs spaced in a longitudinal direction, with each leg having J-shaped cross sections perpendicular to the longitudinal direction, with each leg including a longer post, a shorter post, and a base extending from the longer post to the shorter post, with each leg further including a table top support portion extending from an upper end of the longer post, and a bench support portion extending from an upper end of the shorter post, with each leg further including a ridge extending from the table top support portion to the bench support portion through the longer post, the base, and the lower post, with each leg further including a recess defined in an upper face of the table top support portion;

a crossbar extending in the longitudinal direction, with the crossbar including two ends spaced in the longitudinal direction, with each end of the crossbar connected to the longer post of one of the two legs;

a table top including planks, bars for supporting the planks in a transverse direction perpendicular to the longitudinal direction, and a tube for supporting the planks in the longitudinal direction, wherein the table top is supported on the table top support portions of the two legs with the tube being received in the recesses of the table top support portions of the two legs;

a bench supported on the bench support portions of the two legs in the longitudinal direction; and screws securing the crossbar to the two legs, securing the table top to the table top support portions of the two legs, and securing the bench to the bench support portions of the two legs.

* * * * *